US007000390B2

(12) United States Patent
Wood

(10) Patent No.: US 7,000,390 B2
(45) Date of Patent: Feb. 21, 2006

(54) STIRLING CYCLE ENGINE OR HEAT PUMP WITH IMPROVED HEAT EXCHANGER

(75) Inventor: James Gary Wood, Albany, OH (US)

(73) Assignee: Sunpower, Inc., Athens, OH (US)

( * ) Notice: Subject to any disclaimer, the term of this patent is extended or adjusted under 35 U.S.C. 154(b) by 0 days.

(21) Appl. No.: 11/185,566

(22) Filed: Jul. 20, 2005

(65) Prior Publication Data

US 2005/0268606 A1 Dec. 8, 2005

Related U.S. Application Data

(62) Division of application No. 10/858,726, filed on Jun. 2, 2004, now abandoned.

(51) Int. Cl.

| | |
|---|---|
| ***F25B 9/00*** | (2006.01) |
| ***F02G 1/04*** | (2006.01) |
| ***F28D 17/00*** | (2006.01) |
| ***F28D 20/00*** | (2006.01) |
| ***F01B 29/10*** | (2006.01) |

(52) U.S. Cl. ..... 60/520; 60/526; 165/10; 165/DIG. 9

(58) Field of Classification Search ..... 60/517, 60/520, 526; 29/890.034; 138/111, 115, 138/117; 165/90, 164, 165, DIG. 395, 10, 165/DIG. 9; 62/6

See application file for complete search history.

(56) References Cited

U.S. PATENT DOCUMENTS

| | | | | |
|---|---|---|---|---|
| 2,596,057 | A * | 5/1952 | Heeckeren et al. | 165/10 |
| 2,833,523 | A * | 5/1958 | Den Haan | 60/526 |
| 4,052,854 | A | 10/1977 | du Pre et al. | |
| 4,126,995 | A * | 11/1978 | Asselman et al. | 165/10 |
| 4,209,061 | A * | 6/1980 | Schwemin | 165/10 |
| 4,215,727 | A * | 8/1980 | ter Wijlen | 138/112 |
| 4,429,732 | A | 2/1984 | Moscrip | |
| 4,452,303 | A * | 6/1984 | Bontje et al. | 165/142 |
| 5,072,497 | A * | 12/1991 | Zaoralek et al. | 492/46 |
| 5,214,923 | A * | 6/1993 | Kown | 60/520 |
| 5,373,634 | A | 12/1994 | Lipp | |
| 6,526,750 | B1 * | 3/2003 | Bliesner et al. | 60/526 |

FOREIGN PATENT DOCUMENTS

| | | | |
|---|---|---|---|
| JP | 62082264 | A * | 4/1987 |
| JP | 01240759 | A * | 9/1989 |

* cited by examiner

*Primary Examiner*—Sheldon J Richter
(74) *Attorney, Agent, or Firm*—Frank H. Foster; Kremblas, Foster, Phillips & Pollick

(57) ABSTRACT

A Stirling cycle machine heat exchanger and a method for making the heat exchanger including, forming an annular ring of a solid heat conductive mass, the annular ring having a central axis and having axially opposite faces. A plurality of passages are drilled through the annular ring and through the opposite faces to provide passages for the flow of a fluid through the passages and transfer of heat energy between the mass and the fluid. The passages are preferably parallel to the axis and have a circular cross section and are arranged in a plurality of circumferentially spaced sets of passages, each set having a plurality of radially spaced passages.

7 Claims, 1 Drawing Sheet

STIRLING CYCLE ENGINE OR HEAT PUMP WITH IMPROVED HEAT EXCHANGER

CROSS-REFERENCES TO RELATED APPLICATIONS

This application is a division of my application Ser. No. 10/858,726 filed Jun. 2, 2004 and now abandoned.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

1. Field of the Invention

This invention relates generally to heat exchangers and a method for manufacturing a heat exchanger, and more specifically relates to an internal heat exchanger for a free piston, Stirling cycle machine.

2. Description of the Related Art

Many machines require the transfer of heat from one mass to another such as transfer between a mass within the machine to a mass external of the machine. Free piston Stirling engines, heat pumps and coolers commonly require heat transfer both from outside its hermetically sealed pressure vessel, through the pressure vessel wall to the working gas at one location within the pressure vessel to provide a heat acceptor system and heat transfer from the gas within the machine at another location through the pressure vessel wall to a mass, such as a coolant, outside the pressure vessel to form a heat rejecter system. In order to improve the efficiency and rate of heat transfer, heat exchangers are commonly employed both interiorly and exteriorly of the Stirling machine's pressure vessel. An interior heat exchanger exchanges heat with the working gas in the machine's interior and conducts the heat to or from the pressure vessel wall. An exterior heat exchanger exchanges heat with an exterior heat source or a coolant, such as ambient air or a circulating coolant and conducts the heat to or from the pressure vessel wall. U.S. Pat. No. 4,052,854 to du Pré discusses heat transfer in a Stirling engine or heater.

U.S. Pat. No. 4,429,732 to Moscrip describes a regenerator, which is similar to a heat exchanger but stores heat and alternately transfers heat to and from the working gas and the mass of the regenerator as the working gas cycles through the regenerator. U.S. Pat. No. 5,373,634 to Lipp, although not for a Stirling machine, shows a heat exchanger having straight, open-ended passages with channels or orifices drilled into the sides of the structure transverse to the straight passages.

In the prior art, the larger Stirling machines usually resort to internal heat exchangers which are constructed of several parallel tubes conductively connected to the pressure vessel wall in order to increase the through-wall heat transfer surface area. However, such tubular heat exchangers require numerous braze joints for attaching the tubes to the wall. This large number of joints also greatly increases the probability of failure because of leakage and also increases the cost of fabrication.

Smaller Stirling machines commonly use a monolithic head construction where heat is transferred through the wall of the pressure vessel of the machine. When a monolithic head is used, it is common practice to braze an internal finned surface, often in the form of folded fins, to the head of the pressure vessel. Such heat exchangers have gas flow between parallel plates, where flow uniformity is extremely sensitive to the plate spacing because the mass flow rate is proportional to the cube of gap between the fins. Mass flow through the corners is therefore limited. The folded fins are fabricated from a sheet of material folded into multiple fins with passages between the fins. This process requires multiple steps of bending and forming, in addition to brazing the sheet components for connection to the head of the pressure vessel. Additionally, folded fins are not generally available in the spacing required by Stirling machines so they often require secondary annealing and resizing. Each of these fabrication steps adds further expense to the cost of the heat exchanger.

In addition to folded fins, radial fins have also been machined into a heat exchanger.

Therefore, it is an object and feature of the invention to provide an improved, more efficient and less expensively manufactured heat exchanger particularly for a Stirling machine.

Another object and feature of the invention is to provide a method for forming a heat exchanger at moderate cost that allows for efficient heat transfer.

BRIEF SUMMARY OF THE INVENTION

The invention is an improved, free piston, Stirling cycle machine having a displacer reciprocatable in a pressure vessel that contains a working gas and having heat exchangers in thermally conductive contact with the pressure vessel for transporting heat between the interior and exterior of the pressure vessel. The improvement is a heat exchanger comprising: an annular ring formed of a heat conductive solid mass and in thermally conductive connection to the interior of the pressure vessel. The annular ring has a central axis and axially opposite faces with a plurality of linear passages through the ring and the opposite faces. The passages are in fluid communication with the working gas for flow of working gas through the passages and transfer of heat energy between the mass and the working gas.

Figure 1:
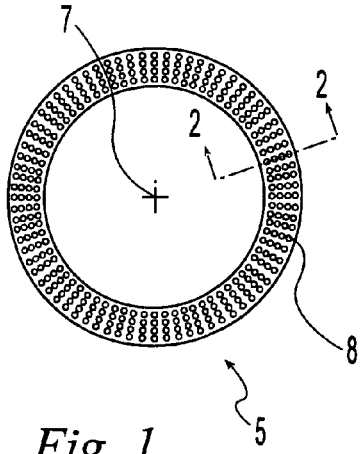
FIG. 1 is a top view of the preferred embodiment of the present invention.

In describing the preferred embodiment of the invention, which is illustrated in the drawings, specific terminology will be resorted to for the sake of clarity. However, it is not intended that the invention be limited to the specific term so selected and it is to be understood that each specific term includes all technical equivalents, which operate in a similar manner to accomplish a similar purpose.

DETAILED DESCRIPTION OF THE INVENTION

The preferred embodiment of the present invention is illustrated in FIG. 1. The invention is a heat exchanger 5 for transferring heat energy between the interior of a Stirling cycle machine and the exterior of the machine. The heat exchanger 5 is formed from a heat conductive solid mass, such as copper or aluminum, into an annular ring having a central axis 7 and axially opposite faces 9 and 11. The mass is a solid in the sense that it is not constructed by connecting together a plurality of frame and/or wall members but rather begins as an integral solid piece of material. A plurality of linear passages 8 are formed through the ring 6 and the opposite faces 9 and 11 to permit flow of a fluid through the passages 8 and transfer of heat energy between the mass and the fluid.

Figure 2:
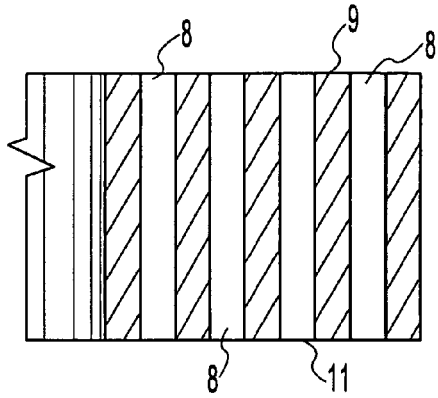
FIG. 2 is an enlarged, cross-sectional view of a portion of the embodiment of FIG. 1 taken substantially along the line 2—2 of FIG. 1.

In the preferred embodiment, the passages 8 are parallel to the central axis 7 of the annular ring and have a circular cross section as illustrated in FIGS. 1 and 2. The passages 8 are arranged in a plurality of circumferentially spaced sets of passages 8, each set having a plurality of radially spaced passages 8. Preferably, each set of passages 8 includes two to four aligned passages 8 arranged along a radial of the ring, with four being illustrated in FIGS. 1 and 2. However, other quantities and configurations of passages can be used and are selected as a function of the size of the heat exchanger, the size of the holes to accomplish the desired fluid flow characteristics and the desired heat transfer characteristics.

The method for forming the passages 8 can include drilling or casting. Drilling can be accomplished by traditional metal forming techniques, which include drilling using a rotating drill bit or electric discharge machining (EDM). The passages 8 preferably have a circular cross section and cylindrical walls when manufactured in accordance with the preferred method of manufacture. However, when the passages are cast or machined, a variety of shapes are available, for example, the passages can be cast with cross sections that are square, rectangular, oval, or radial slots.

Preferably, the solid heat conductive mass is a single piece, unitary solid mass or block that is formed into an annular ring. Alternatively however, the annular ring can be formed in discrete, separate segments each of which are a solid mass or block. For example, the ring can consist of two 180 degree half ring segments, four 90-degree segments or six 60-degree segments. The annular ring preferably does not consist of such multiple component parts, but forming the ring of such component parts does not depart from the concept of the invention. Additionally, it is not necessary, although it is preferred, that the ring be entirely endless or complete. For example, the ring can extend, for example, only 330° around a circle leaving a 30° segment for another structure extending parallel to its axis. The ring is generally annular, but may include some departures from perfectly circular walls, including tabs, fingers or other projecting structures, or cut outs, such as grooves or channels. The ring's outer contour preferably conforms to the contour of the interior wall of the pressure vessel of a Stirling Machine for optimizing thermally conductive connection and is preferably brazed to that wall.

Figure 3:
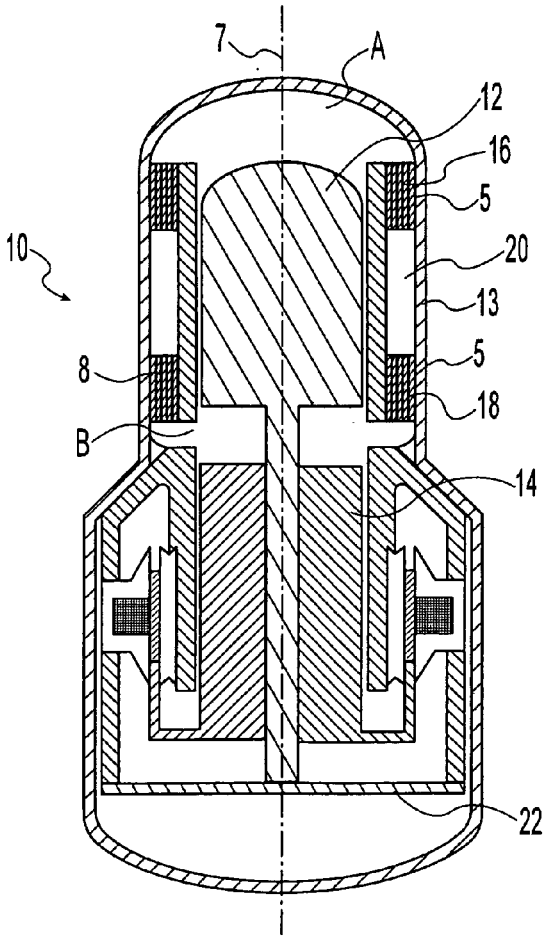
FIG. 3 is a cross-sectional view of a Stirling machine illustrating the positioning of embodiments of FIG. 1.

The preferred embodiment of the invention is particularly suited as an internal heat exchanger for improving a free piston, Stirling cycle machine. Referring to FIG. 3, the Stirling machine 10 has a displacer 12 reciprocatable in a pressure vessel 13 that contains a working gas. Internal heat exchangers 16 and 18 are in thermally conductive contact with the pressure vessel 13 for transporting heat between the interior and exterior of the pressure vessel. They are annular rings, like the heat exchanger 5 of FIG. 1, brazed to the internal wall of the pressure vessel 13. Specifically, an internal heat acceptor 16 and an internal rejecter 18 are mounted within the pressure vessel 13.

As an alternative configuration, the peripheral wall surface of the annular ring that forms the internal heat exchanger of the heat acceptor system (the upper heat exchanger in a machine like that illustrated in FIG. 3) can be formed into a frusto-conical or dome-shaped contour in order to matingly engage a similarly contoured interior upper wall of the head of the pressure vessel 13. The entire annular ring also can be made in a similar shape and it is not necessary that the opposite faces be parallel. However, the passages will still extend between opposite faces of the annular ring. For example, if the annular ring is made in a frusto-conical shape, the passages may not be parallel to the central axis, but may be aligned obliquely to the axis, such as lying along an imaginary conical surface.

In accordance with the well know operating principles of the Stirling cycle machine, the working gas, typically helium, within the Stirling cycle machine 10 is shuttled between region A and region B during operation. The present invention aids in the transfer of heat energy between the working gas and the internal acceptor 16 and rejecter 18 during operation of the machine. As working gas is displaced through the passages 8 of the preferred embodiment, heat energy is transferred to or from the gas to the walls of the passages 8 and also is conducted through the acceptor and rejecter heat exchangers 16 and 18. The heat energy is also conducted through the pressure vessel 13.

The preferred embodiment of the present invention is believed to be advantageous over the prior art heat exchangers for a variety of reasons. Although the efficiency of the heat transfer is often so important that the better heat exchanger is preferred even if it is more expensive, fabrication of a heat exchanger in accordance with the present invention is believed less expensive because modern, computer controlled machining equipment is very time efficient in the accurate drilling of multiple holes. Furthermore, because the holes are drilled through a solid block of material, the remaining metal provides a thermal conduction path with a maximum cross section for heat conduction between the pressure vessel and the walls of the holes.

Although gas flow through any heat exchanger is sensitive to the spacing between the walls of the passages, and therefore gas flow through cylindrical passages is sensitive to the diameter of the passages, the passages of the preferred embodiment will have a diameter approximately twice the gap in a conventional parallel plate heat exchanger. Therefore, flow resistance will be improved and the gas will be equally exposed to the entire, interior wall surface of the cylindrical passages for maximizing heat transfer between those walls and the gas. Furthermore, any heat radiated from the cylindrical passage walls will be radiated to another portion of the cylindrical wall instead of being radiated to another structural component within the machine.

While certain preferred embodiments of the present invention have been disclosed in detail, it is to be understood that various modifications may be adopted without departing from the spirit of the invention or scope of the following claims.

What is claimed is:

1. An improved, free piston, Stirling cycle machine having a displacer reciprocatable in a pressure vessel that contains a working gas and having heat exchangers in thermally conductive contact with the pressure vessel for transporting heat between the interior and exterior of the pressure vessel, wherein the improvement is a heat exchanger comprising:

an annular ring formed of a heat conductive solid mass and in thermally conductive connection to the interior of the pressure vessel, the annular ring having a central axis and axially opposite faces, the ring having a plurality of linear passages through the ring and the opposite faces, the passages being in fluid communication with the working gas for flow of working gas through the passages and transfer of heat energy between the mass and the working gas.

2. A machine in accordance with claim 1, wherein the annular ring is brazed to the internal wall of the pressure vessel.

3. A machine in accordance with claim 1, wherein the passages are parallel to the axis.

4. A machine in accordance with claim 3, wherein the passages are arranged in a plurality of circumferentially spaced sets of passages, each set comprising a plurality of radially spaced passages.

5. A machine in accordance with claim 4, wherein the passages have a circular cross section.

6. A machine in accordance with claim 5, wherein each set comprises at least two aligned passages arranged along a radial of the ring.

7. A machine in accordance with claim 6, wherein the annular ring is brazed to the internal wall of the pressure vessel.

* * * * *

UNITED STATES PATENT AND TRADEMARK OFFICE

CERTIFICATE OF CORRECTION

PATENT NO. : 7,000,390 B2
APPLICATION NO. : 11/185566
DATED : February 21, 2006
INVENTOR(S) : James Gary Wood It is certified that error appears in the above-identified patent and that said Letters Patent is hereby corrected as shown below:

Column 1, line 16, insert the following:

-- This invention was made with government support under contract NAS3-02070 awarded by NASA. The government has certain rights in the invention. --.

Signed and Sealed this
First Day of January, 2013

David J. Kappos

David J. Kappos
*Director of the United States Patent and Trademark Office*